US011009312B2

(12) United States Patent
Thomann

(10) Patent No.: US 11,009,312 B2
(45) Date of Patent: May 18, 2021

(54) SPRAY DEVICE

(71) Applicant: PIEXON AG, Aarwangen (CH)

(72) Inventor: Juerg Thomann, Stengelbach (CH)

(73) Assignee: PIEXON AG, Aarwangen (CH)

( * ) Notice: Subject to any disclaimer, the term of this patent is extended or adjusted under 35 U.S.C. 154(b) by 0 days.

(21) Appl. No.: 15/852,121

(22) Filed: Dec. 22, 2017

(65) Prior Publication Data

US 2018/0216909 A1 Aug. 2, 2018

(30) Foreign Application Priority Data

Dec. 22, 2016 (CH) ..... 1709/16

(51) Int. Cl.
*F41B 9/00* (2006.01)
*F41H 9/10* (2006.01)
*F41B 6/00* (2006.01)

(52) U.S. Cl.
CPC ..... *F41B 9/0037* (2013.01); *F41B 6/00* (2013.01); *F41B 9/0062* (2013.01); *F41B 9/0087* (2013.01); *F41H 9/10* (2013.01); *F41B 9/0059* (2013.01)

(58) Field of Classification Search
CPC ..... F41H 9/10; F41B 9/0037; F41B 9/0062; F41B 9/0087
USPC ..... 124/71
See application file for complete search history.

(56) References Cited

U.S. PATENT DOCUMENTS 3,971,292 A * 7/1976 Paniagua ..... A01M 3/007 89/1.11
4,615,488 A * 10/1986 Sands ..... F41B 9/0075 222/79
4,706,848 A * 11/1987 D'Andrade ..... F41B 9/0037 222/333
4,750,641 A * 6/1988 Chin-Fu ..... F41B 9/0037 222/318
5,103,366 A * 4/1992 Battochi ..... F41H 13/0037 361/232
5,230,324 A * 7/1993 Van Horssen ..... F41B 11/723 124/61
5,244,153 A * 9/1993 Kuhn ..... F41B 9/0075 222/401

(Continued)

FOREIGN PATENT DOCUMENTS

CA 2 463 340 A1 10/2005
KR 101157823 B1 6/2012
WO WO 00/73726 A2 12/2000

OTHER PUBLICATIONS

European Search Report dated Jun. 6, 2018 issued in corresponding EP Application No. 17210302.0.

*Primary Examiner* — Bret Hayes

(74) *Attorney, Agent, or Firm* — Birch, Stewart, Kolasch & Birch, LLP.

(57) ABSTRACT

A device (100) for firing a projectile at a target body, in particular a fluid projectile or solid projectile, comprises a hand-held unit (100) for firing the projectile, the hand-held unit (100) comprises a propulsion drive (114) for accelerating the projectile and a distance measuring device (112) for measuring a distance between the hand-held unit (100) and the target body. The device (100) also comprises an energy store (120) for operating the propulsion drive (114), the propulsion drive (114) comprising a control unit (115), whereby the propulsion (114) is controllable in dependence on the distance measured.

24 Claims, 4 Drawing Sheets

(56) References Cited

U.S. PATENT DOCUMENTS

| | | | | | |
|---|---|---|---|---|---|
| 5,730,325 | A * | 3/1998 | Cheung | F41B 9/0037 | 222/255 |
| 5,876,995 | A * | 3/1999 | Bryan | A23G 3/366 | 435/189 |
| 5,893,483 | A * | 4/1999 | Duran | F41H 9/10 | 206/38.1 |
| 5,921,442 | A * | 7/1999 | Keller | B05B 11/3015 | 222/153.13 |
| 6,052,051 | A * | 4/2000 | Whalen | F41H 9/10 | 222/1 |
| 6,543,365 | B1 * | 4/2003 | Vasel | F41B 11/57 | 102/367 |
| 8,087,968 | B2 * | 1/2012 | Amron | F41B 9/0018 | 239/237 |
| 8,678,877 | B2 * | 3/2014 | Corlett | F41B 11/642 | 124/56 |
| 9,022,255 | B1 | 5/2015 | Calvert | | |
| 2001/0015125 | A1 * | 8/2001 | Poole | F41H 9/10 | 89/1.11 |
| 2007/0289995 | A1 * | 12/2007 | Zimmerman | F41B 9/0037 | 222/79 |
| 2014/0166782 | A1 * | 6/2014 | Hwang | F41H 9/10 | 239/373 |
| 2016/0161212 | A1 * | 6/2016 | Bergeron | F41B 11/68 | 124/73 |
| 2018/0051964 | A1 * | 2/2018 | Forsythe | B05B 9/01 | |

* cited by examiner

SPRAY DEVICE

TECHNICAL FIELD

The invention relates to a device and a method for firing a projectile at a target body, comprising a hand-held unit for firing the projectile, the hand-held unit comprising a propulsion drive for accelerating the projectile and a distance measuring device for measuring a distance between the hand-held unit and the target body, the device also comprising an energy store for operating the propulsion drive. The invention also relates to a device for firing a fluid projectile at a target body, comprising a hand-held unit for firing the fluid projectile, the hand-held unit comprising a propulsion drive for accelerating the fluid projectile, the device also comprising an energy store for operating the propulsion drive.

PRIOR ART

Devices for spraying irritants are known in various embodiments and are used not only by the police and army but also by private individuals, especially for self defense.

A first known embodiment is formed as an irritant spray device and comprises a pressure vessel with irritant, the irritant being able to leave under pressure by way of a nozzle under the control of a valve (pushbutton or the like).

In principle, the irritant may in this case be liquid or take the form of a foam or gel. The spray pattern may in principle correspond to a cone-shaped mist or a jet. In the case of a jet, it may be ascribed ballistic characteristics if the jet hits a target body with a relatively small cross-sectional area and at high velocity. This effect is known by the term "hydraulic needle effect". The irritant itself may for example comprise *capsicum*.

The known devices for spraying irritants have the disadvantage that, in particular in the case of a variant with a spray jet, when used against people they can cause injuries. In particular, because of the "hydraulic needle effect", when used at short range an eye injury cannot be ruled out.

SUMMARY OF THE INVENTION

The object of the invention is to provide a device for spraying an irritant belonging to the technical field mentioned at the beginning with which a risk of injury by a jet can be reduced.

The solution achieving the object is defined by the features of claim 1. According to the invention, the propulsion drive comprises a control unit, whereby the propulsion is controllable in dependence on the distance measured.

In a corresponding method for operating a device for firing a projectile at a target body, in particular a liquid projectile or solid projectile, a device is used comprising a hand-held unit for firing a projectile and also a propulsion drive for accelerating the projectile and a distance measuring device for measuring a distance between the hand-held unit and the target body. The device also comprises an energy store for operating the propulsion drive. The propulsion drive comprises a control unit, whereby the propulsion is controlled in dependence on the distance measured.

Controlling the propulsion in dependence on the distance measured between the hand-held unit and the target body makes it possible to regulate the discharge velocity of the projectile. This allows for example a discharge amount, a discharge time (length of projectile) and/or a discharge velocity from the hand-held unit to be regulated. In particular when there is a short distance between the hand-held unit and the target body, the kinetic energy can in this way be kept low, so that injuries, in particular eye injuries, caused by the so-called "hydraulic needle effect" can be avoided.

The projectile is formed in a preferred embodiment as a fluid projectile. It is particularly preferably a liquid projectile or a liquid jet. The fluid projectile, or the liquid jet, is preferably of a predefined length, i.e. the propulsion drive is actuated for a predetermined time period when the device is actuated.

In variants, the projectile may also be formed as a solid body, as a soft, for example gel-like body or the like. The fluid projectile does not necessarily have to be of a predetermined length. The device may also be formed in such a way that the propulsion drive is actuated for as long as the user actuates the device.

Unless mentioned otherwise, the terms "spraying" and "spray device" or the line are understood hereinafter as meaning in principle the discharge of a liquid jet and a corresponding device.

The term hand-held unit is understood as meaning a unit which can be operated with one hand and which can be carried by the user in one hand. For this purpose, the hand-held unit has at least one handle. For being supplied with projectiles, in particular with irritant, and also for being supplied with energy, the hand-held unit may however also be connected by way of corresponding lines or tubes to a storage container or an energy store (see below).

The hand-held unit comprises a propulsion drive for accelerating the projectile. The propulsion drive may be formed in various ways. On the one hand, it may take the form of a pressurized medium which accelerates the irritant. The irritant may also itself be under pressure and thus provide the propulsion. The use of cold gas has long been known in the area of spray cans and for irritant spray devices. The propulsion may however also be provided by a pyrotechnic propellant, static charge, magnetic fields, etc. A person skilled in the art knows of many possible types of propulsion drive for this. With the propulsion drive, the projectile is accelerated to its maximum velocity, whereupon the projectile is decelerated to zero because of air friction or as a result of impact with a target body. During this, the projectile describes approximately (disregarding air resistance) a parabolic flight.

The distance measuring device is formed in such a way that it can be used for measuring a distance between the hand-held unit and a target body. For this purpose, the distance measuring device is preferably arranged in the region of an outlet opening of the hand-held unit and preferably measures a distance between the outlet nozzle of the hand-held unit and a presumed target, which in the present case would be hit if the propulsion drive were actuated. The distance measuring device preferably emits a distance signal to a processor, which determines from it, and possibly from further parameters, the pump output. The further parameters may for example comprise a fluid temperature (for example to allow for the viscosity of the fluid), the outside temperature, atmospheric humidity, elevation of the nozzle (in particular if it is not automatically adjustable, see further below in this respect), etc.

The energy store provides the acceleration energy for the projectile. The energy store may comprise a capacity for the acceleration of one or more projectiles.

The control unit serves for controlling the propulsion in dependence on a distance measured with the distance measuring device. The control unit is preferably a computing unit, in particular a processor, whereby the distance data can be converted into an amount of energy with which the projectile is accelerated.

In a preferred embodiment, the fluid projectile is formed as an irritant fluid projectile, in particular as an irritant fluid projectile enriched with a UV-sensitive substance. Consequently, the device preferably comprises an irritant spray device. The use of UV-sensitive substances in the irritant achieves the effect that, when exposed to UV light, both the irritant jet during the firing and the person hit can be detected well. The UV light source is preferably arranged on the hand-held unit, but may also be formed as a device that is separate from the device (pocket lamp, etc.). The illumination of the UV-sensitive substance in the jet has the effect of further increasing the hit accuracy, since the user is well able to visually follow the otherwise scarcely visible jet, in particular even in the dark.

In variants, the fluid projectile may also merely comprise a dye or the like, whereby an object or person can be marked. Furthermore, the device may be designed for firing solid projectiles that are for example accelerated by way of a magnetic field, and where the magnetic field is controlled by means of the data of the distance sensor. It is also possible that the propulsion drive for the solid projectile may be provided by a number of pyrotechnic charges, a number of charges being activated by means of the data of the distance sensor.

The hand-held unit preferably comprises the control unit. In this way, a compact form of the device is achieved. Furthermore, because of short distances, particularly short reaction times can in this way be achieved for controlling the device. Alternatively, the control unit may also be taken along separately, for example decentrally or in a pocket or bag, a backpack or the like.

A power output of the propulsion drive is preferably controllable in dependence on the distance measured.

The control is preferably formed in such a way that, below a predetermined limit distance between the hand-held unit and the target body, the propulsion drive is operated in such a way that the projectile leaves the hand-held unit with lower velocity than if the predetermined limit distance is exceeded. The control may also be formed in such a way that, below the limit distance, the propulsion drive is not activated. In a further preferred embodiment, a number of limit distances are provided, between which a power output of the propulsion drive is assigned in each case, it optionally being possible for the control to be formed in such a way that, below a minimum limit distance, the propulsion drive is switched off entirely. Furthermore, the control may also be designed in such a way that, if the distance exceeds a maximum limit distance, at which hitting the object is ruled out or improbable, the propulsion drive is switched off. This allows economical use of the device, in particular of the fluid, to be achieved.

In the case of a design as an irritant spray device, it is thereby achieved that at a short distance the fluid projectile has a lower kinetic energy, so that the risk of injury to a targeted person can be reduced. The fact that the propulsion drive is switched off below a minimum limit distance means that contamination of the user with the irritant can be avoided.

In a particularly preferred embodiment, the power output of the propulsion drive is continuously adapted to the distance measured. It can thereby be achieved that an impact energy of the projectile on the body can be kept substantially constant irrespective of the distance. The continuous adaptation of the power output of the propulsion drive in dependence on the distance of the hand-held unit from the body achieves the further effect of user-friendly operation, since in this way the effects of the parabolic flight of the projectile when aiming at the target can be reduced—and consequently the influence of the firing angle on the aiming accuracy can be reduced.

In variants or in addition, a time period for the spraying of the irritant may also be controlled in dependence on the distance measured. Furthermore, instead of an output of a fluid projectile, the projectile may also be altered. For example, at a short distance, instead of a fluid jet an atomization or the like may be provided, whereby a risk of injury can likewise be reduced.

Preferably, a firing angle of the projectile in relation to the hand-held unit is controllable in dependence on the distance measured and/or in dependence on the power output of the propulsion drive. For this purpose, the hand-held unit preferably comprises an outlet channel, by way of which the projectile leaves. The angle of the outlet channel in relation to the hand-held unit is preferably variable. In a preferred embodiment, the angle of the outlet channel in relation to the hand-held unit is adjustable in a motorized manner, in particular for example by way of a servo or a micro servo.

In variants, the firing angle may also be controllable independently of the distance measured, in particular it may for example be manually adjustable. The propulsion drive is preferably electrically operable and the energy store comprises in particular at least one rechargeable battery. The use of an electrically operable propulsion drive has the advantage that it can be easily regulated, and that the electrical output is regulated. Furthermore, electrical types of propulsion drive are inexpensive to produce.

In variants, a pyrotechnic propellant charge may also be provided, for example only part of the propellant charge being ignited when there is a short distance between the hand-held unit and the target body. Furthermore, cold gas may be provided as the propulsion drive, it being possible for the power output to be adjusted by way of a valve.

In a preferred variant, the energy store comprises at least two rechargeable batteries, the control unit being formed in such a way that the propulsion drive can be operated with one rechargeable battery or with more than one rechargeable battery in dependence on the distance measured. A particularly simple form of control is thereby realized, whereby the propulsion drive can be operated with varying output. Preferably, when the distance between the hand-held unit and the target body is less than a limit distance, the propulsion drive is only operated with one rechargeable battery, whereby the projectile leaves the hand-held unit, in particular a mouth of the hand-held unit, with reduced discharge velocity.

Alternatively, the output may also be regulated purely electronically. In particular, the output for the propulsion drive may also be continuously controlled in relation to the distance measured. The relation of the output to the distance measured does not have to be linear here, but may for example be calibrated on the basis of measured values determined.

The propulsion drive is preferably formed as a pump. In particular together with the electrical energy store, the pump can be controlled particularly easily. Electric pumps are also inexpensive and can be easily integrated in a hand-held unit. The pump is preferably formed in such a way that a pump output can be controlled by way of the power supply. This is of advantage because, after measuring the distance between the hand-held unit and the target body, a quick changeover is necessary, so that firing is performed with the correct setting. Alternatively, control of the pump by way of a valve would also be conceivable, in which case it would possibly be necessary for a disabling of the device to be provided during the changeover, so that the device is only ready to fire after the setting adjustment has been performed.

In variants, the propulsion drive may also be provided by a pyrotechnic propellant. The propulsion drive may however also be provided by way of gas pressure, for example a gas cartridge. The propulsion drive may also comprise a spring, which is pretensioned, or the like. Furthermore, depending on the projectile, magnetic fields or the like may also be used; a person skilled in the art knows of further variants.

The pump is preferably formed as a peristaltic pump. The peristaltic pump is a positive displacement pump in which a fluid can be transported by a tube being deformed. The deformation typically takes place by way of a rotor, which pinches the tube locally against the pump casing by means of rollers or sliding shoes and thus advances the content of the tube by the rotation of the rollers or sliding shoes. In this way, the irritant can be propelled by the peristaltic pump out of the cylinder through the outlet nozzle in order to produce the fluid projectile. In this way, a particularly inexpensive variant of the device is achieved, in particular because peristaltic pumps comprise only few moving parts. The peristaltic pump also has the advantage that it is particularly robust and unproblematic with regard to leak-tightness, in particular because the fluid does not come into contact with any sealing surfaces that are moving in relation to one another, as is the case for example with a reciprocating pump. Furthermore, this allows a discharge velocity to be controlled relatively easily by the rotational speed of the motor.

The peristaltic pump typically comprises an electric motor and a rotor, where a tube can be pinched by the rotor. For this purpose, in the present case the rotor has a circular-cylindrical basic form, with two flanges spaced axially apart from one another and protruding radially, rollers for pinching the tube being arranged between the flanges. In order to achieve a space-saving construction, in the present case the circular cylinder of the rotor is hollow on the inside and open at one end, so that it can be fitted over a motor housing or over a motor or else over a gear unit or gear housing of the motor. During operation, the tube is consequently arranged around the motor or around the gear unit. A particularly compact structural form is achieved in this way. In variants, the peristaltic pump may also be formed differently, in particular neither the gear unit nor the motor has to be accommodated in a hollow space of the rotor.

In variants, the pump may also be formed as a diaphragm pump or gear pump. In the case of a diaphragm pump, the diaphragm may for example be deflected mechanically or electromagnetically. The diaphragm pump may be formed as a micro diaphragm pump, which can be operated with commercially available batteries. A person skilled in the art also knows of other means of transporting the fluid.

The hand-held unit preferably comprises a fluid container, which can be fluidically connected to the pump. As a result, the fluid lines can be kept short, whereby the pump has to overcome correspondingly small frictional resistances. Consequently, the pump output can be used for the most part for the acceleration of a fluid projectile. The fluid container is preferably an exchangeable unit.

In variants or in addition, the fluid container may also be comprised by the device separately from the hand-held unit.

The pump is preferably connectable to the fluid container in the manner of a force closure by way of a conical connection. A conical connection is understood hereinafter as meaning an outer cone of a first fluid line which can be inserted into an inner cone of a second fluid line in order to achieve a fluid connection. The conical design of the connection has the effect that a leak-tight connection is created by simple means.

In variants, other connecting techniques for fluid connections that are known to a person skilled in the art may also be used. In particular, a bayonet connection, a screw connection, some other plug-in or latching connection etc. may be provided.

The conical connection preferably comprises a securement, in particular a screw connection, in order to secure the conical connection. This achieves the effect that the conical connection cannot come undone during operation. The screw connection preferably comprises a sleeve with an internal thread that surrounds the outer cone, while the inner cone comprises a corresponding external thread, or a radially protruding shoulder, which can interact with the internal thread. In this way, a particularly simple connection of the fluid container to the pump is achieved.

Furthermore, however, the fluid container itself may also be secured on the hand-held unit by way of any desired securing means known to a person skilled in the art, so that the conical connection cannot come undone. Thus, the fluid container may for example have an external thread, which engages in an internal thread of a corresponding receptacle of a housing of the hand-held unit. Furthermore, the fluid container may be secured on the housing by a clip, a screw closure, a flexible element, etc., in such a way that the conical connection cannot come undone.

In variants, it is also possible to dispense with the securement, in particular if the force-closure connection is sufficiently strong.

Particularly preferably, the fluid container and the pump comprise a Luer lock connection, by way of which the fluid container can be fluidically connected to the pump. This achieves a connection between the pump and the fluid container which can be produced particularly easily, is leak-tight and secure that has proven successful in particular in the area of medical syringes. The Luer lock connection also has the advantage that, when the fluid container is exchanged, there is a relatively small risk of contamination with the fluid. This is of great relevance in particular when irritants are used as the fluid.

In variants, other connecting techniques can also be used.

The fluid container preferably has a variable volume. There is consequently no need for a pressure equalization when the fluid is being removed, whereby in turn a risk of leakage, and consequently contamination, can be reduced.

In variants, the fluid container may also have an invariable volume. In this case, for example, a nonreturn valve may be provided in order to equalize the pressure. Furthermore, the fluid container may also be subjected to pressure.

Preferably, the fluid container comprises a cylinder with a piston that can be moved within the cylinder. The cylinder is preferably fluidically connected to the pump, so that with the pump a fluid projectile can be removed from the cylinder, whereby the piston moves in the cylinder, preferably exclusively by the negative pressure caused by the pump. As an alternative to this, however, the piston may also be fluidically connected to the pump, so that a fluid projectile can be removed from the cylinder.

The position of the piston in the cylinder is preferably visible when the fluid container is fitted in the hand-held unit. The visibility can be achieved by the cylinder being transparent and either not completely concealed by the hand-held unit or able to be viewed through a viewing window of the hand-held unit. In this way, the filling level of the fluid container can be viewed from outside in a constructionally simple way. The filling level in the fluid container may, however, also be made visible in some other way. For this purpose, the part that is movable in relation to the hand-held unit, that is to say preferably the piston or the cylinder, may be connected to an indicator element, which can reproduce the filling level mechanically or electronically. A person skilled in the art knows of many possibilities for this. Alternatively, the filling level indication can also be dispensed with.

In variants, a pouch-like fluid container may also be provided instead of the cylinder with the piston. Furthermore, a conventional cartridge or bottle, etc. may also be provided as the fluid container. Finally, a linear drive that advances the piston in the cylinder may also be provided instead of the pump. For this purpose, for example, a rack-and-pinion drive may be provided (see further below).

The fluid container preferably comprises a main chamber for a first fluid and a secondary chamber for a second fluid, the main chamber being separated from the secondary chamber by a diaphragm.

It is also possible to dispense with the secondary chamber. Instead of a secondary chamber, an outer space may also be separated off by the diaphragm.

The device preferably comprises a pin, the diaphragm being pierceable by means of emptying the main chamber. For this purpose, the pin is preferably fixedly arranged in relation to the hand-held unit during operation and, during emptying, the diaphragm moves in the direction of the pin, so that in an emptying state, in particular when the main chamber is emptied, the pin pierces the diaphragm, so that the content of the secondary chamber can be transported by the pump. Alternatively, the diaphragm may also be fixedly arranged in relation to the hand-held unit, while during emptying the pin moves in relation to the diaphragm and pierces it.

In the preferred embodiment, the pin is formed as a needle which protrudes inwardly in the cylinder, in the direction of the piston, and through which the fluid is taken in by the pump. The diaphragm preferably separates off a secondary chamber in the piston, so that the needle can penetrate into the secondary chamber directly. In the preferred embodiment, an irritant is provided in the main chamber, while in the secondary chamber there is for example a cleaning agent. This allows the hand-held unit to be freed of remains of irritant after the main chamber has been emptied, before a new fluid container is inserted. In this way, instances of contamination can be avoided. Alternatively, some other additional active agent may also be provided, for example with an agent for marking an offender or for decontamination. Instead of the secondary chamber, the diaphragm may also be used for just opening the cylinder to the outside, so that air can be taken in and the hand-held unit thus cleaned.

The piston and the cylinder are preferably formed as an exchangeable unit. This allows the hand-held unit to be reused in an easy and inexpensive way. Moreover, user-friendly handling is made possible in this way, in particular because there is no need for filling with irritant.

The unit may also comprise further parts. In particular, the unit may for example also comprise the battery for feeding the pump. In this way it is possible to ensure when exchanging the unit that both the battery power and the irritant store are charged. In variants, the batteries may also be formed as separately exchangeable and/or the device may comprise a charging station for the hand-held unit, whereby a rechargeable battery can be charged. The production of this unit comprising the cylinder and the piston can be produced particularly inexpensively in particular by means of injection-molding processes or similar high-capacity production processes.

In variants, it is also possible to dispense with the exchangeable unit. For example, the cylinder may be provided with a refilling opening, by way of which the cylinder can be filled with irritant. Furthermore, the outlet nozzle may also be made such that it can be used for filling the cylinder, in that the piston is drawn back in a motorized manner or manually or in that the pump is operated in the opposite direction. This would have the advantage that the nozzle can in this way be cleaned at the same time. Finally, the hand-held unit together with the fluid container may be formed as a disposable article.

Both the piston and the cylinder may be formed as an injection-molded part, and consequently can be produced particularly easily and inexpensively. However, it is clear to a person skilled in the art that the propulsion drive, in particular the cylinder and the piston, can be made of plastic or else of other substances, such as for example metal or composite materials. Similarly, simple operation of the propulsion drive is thereby achieved, because a discharge of the fluid can be achieved by a linear advancement of the piston. The means for achieving the relative movement between the piston and the cylinder may consequently comprise simple types of propulsion drive that are known to a person skilled in the art.

An exemplary embodiment in which the piston is actively actuated is described in detail below.

In this further preferred embodiment, the propulsion drive comprises a cylinder for receiving a fluid and a piston that can be moved in the cylinder along a longitudinal axis and also means for achieving a relative movement between the piston and the cylinder.

In a variant, the piston itself may comprise an outlet nozzle, by way of which the fluid, in particular in the form of a fluid projectile, can be discharged. For this purpose, the piston may be provided with a propulsion drive, in particular a linear drive, preferably with a rack-and-pinion drive (see below).

In variants, the propulsion drive may be realized in some other way, in particular as a commercially available fluid pump, as already described above.

A discharge device assigned to this variant for discharging a fluid, for use in a device for firing a fluid projectile at a target body, preferably comprises a cylinder and a piston which can be moved in the cylinder along a longitudinal axis and which comprises a toothed rack. Consequently, the hand-held unit may for example comprise an electric motor with a gearwheel, whereby, when the discharge device is inserted in the hand-held unit, the piston can be moved by way of the gearwheel in engagement with the toothed rack.

In this case, the toothed rack is preferably connected in one piece to the piston. Alternatively, the toothed rack may also be formed as a separate component.

The piston preferably comprises a toothed rack, the means for advancing the piston comprising a motor, in particular an electric motor, with a gearwheel, the gearwheel being in engagement with the toothed rack for the advancement of the piston. This provides a particularly simple linear drive, by way of which the piston can be moved in the cylinder. In a particularly preferred embodiment, the propulsion drive comprises an electric motor with a reduction gear unit, in order to achieve an advancement of the toothed rack, and consequently an advancement of the piston in the cylinder, by way of a gearwheel rotation. In a particularly preferred embodiment, the toothed rack is fixedly connected to the piston or is formed in one piece with the piston. The toothed rack is preferably formed on a push rod of the piston. This allows the number of components to be reduced, whereby the device as a whole can be produced less expensively. The toothed rack may however be also be formed as a separate element, in a way similar to the cartridge applicators, cartridge guns, silicone applicators or cartridge applicator guns known to a person skilled in the art, in which the piston is moved in the cylinder by means of a separate push rod.

In variants, other means for advancing the piston may also be provided. In particular, the piston may also be performed by way of a lever mechanism similar to the cartridge applicator. Furthermore, the advancement may also be performed hydraulically or pneumatically, for example by way of a pump, hydraulic advancement being preferable because of the easier controllability.

Preferably, the piston together with the cylinder forms an exchangeable unit. In particular in the case of an application in a reusable irritant spray device, it is of advantage if all of the parts that come into contact with the irritant can be exchanged in an easy way when the irritant container has been emptied. In this way, reliable changing of the irritant containers is ensured, and on the other hand contamination by use is largely avoided. Particularly preferably, therefore, the nozzle connected to the cylinder or formed in one piece with it is likewise also exchanged. In this way it can be avoided that lines, the nozzle, the pump etc. are attacked by the irritant or restricted in their function by residues of the irritant. In particular, it can however be achieved in this way that, at least after each time it is loaded with a new, filled irritant container, that is to say the unit comprising the cylinder and the piston, an operational nozzle is obtained—in the case of systems in which the nozzle is not exchanged, however, there is the risk that over time the nozzle will become clogged with drying-out residues of the irritant.

The unit may also comprise further parts. In particular, the unit may also comprise the battery for feeding the electric motor. In this way it is possible to ensure when exchanging the unit that both the battery power and the irritant store are charged.

The production of this unit comprising the cylinder and the piston can be produced particularly inexpensively in particular by means of injection-molding processes or similar high-capacity production processes. Consequently, the unit preferably comprises the cylinder with the nozzle and the piston with the toothed rack.

The exchangeable unit does not necessarily have to comprise the toothed rack, but may also merely comprise the piston, the toothed rack being provided along with the push rod by the hand-held unit.

In variants, it is also possible to dispense with the exchangeable unit. For example, the cylinder may be provided with a refilling opening, by way of which the cylinder can be filled with irritant. Furthermore, the nozzle may also be made such that it can be used for filling the cylinder, in that the piston is drawn back in a motorized manner or manually. This would have the advantage that the nozzle can in this way be cleaned at the same time.

The hand-held unit preferably comprises the electric motor with the gearwheel for driving the toothed rack, and also a receptacle for the unit comprising the cylinder with the nozzle and the piston with the toothed rack. The unit can be inserted into the receptacle of the hand-held unit in such a way that the toothed rack comes into engagement with the gearwheel. During use, each time the propulsion drive is triggered the toothed rack, and consequently the piston, is moved into the cylinder, whereby the irritant is propelled out of the nozzle as a fluid projectile. The piston, the cylinder and the toothed rack, and also the gearwheel, are preferably dimensioned and arranged in such a way that the piston can be made to enter the cylinder substantially completely. When the piston has entered the cylinder completely, the gearwheel is preferably no longer in engagement with the toothed rack and can rotate freely. In this way, an overloading of the motor after emptying of the unit can be avoided in an easy way. Alternatively, a limit switch that can switch off the propulsion drive in dependence on the relative position in the piston may also be provided.

In variants, the hand-held unit may also comprise the nozzle and/or the toothed rack, whereby a less-expensive exchangeable unit is achieved.

The distance measuring device is preferably formed as a laser sensor. In this way, apart from the distance measurement, the user can also be shown the target that would be hit when the propulsion drive is activated. The aiming accuracy can be increased by means of a pivotable nozzle, in particular an automatically pivotable nozzle. For this purpose, the nozzle angle may be automatically made to match the distance and the power output of the propulsion drive, in order that the point of impact corresponds to the point at which the laser is aimed. Alternatively, instead of the nozzle, the laser may also be pivotably formed, so that the laser beam would be aligned in dependence on the distance and the power output of the propulsion drive, so that the irritant jet coincides with the laser point at the target point.

Furthermore, ultrasonic sensors may also be used. These have the advantage that they operate well even in poor visibility, while for example an infrared measurement may fail in smoke or mist.

In variants, radar or infrared may also be used for the distance measurement. A person skilled in the art also knows of further variants for this.

The hand-held unit preferably comprises an intake pin, whereby a fluid projectile can be removed from a fluid container. In particular when the device is used as a pepper spray, there is the advantage that the irritant, preferably liquid irritant, may be in pressureless containers, that is to say the containers containing the irritant are not under pressure. In this way for example exchangeable containers can be provided, so that for example the hand-held unit is reusable.

In variants, it is also possible to dispense with the intake pin, in particular if the fluid container is inserted upside down into a receptacle of the hand-held unit.

Particularly preferably, the fluid container is a disposable pack. This is of advantage in particular in the case where irritants are used, because unwanted contamination with irritant can be avoided in this way. Alternatively, a refillable pack may also be provided.

The intake pin is preferably designed for piercing a fluid container, in particular for piercing a septum of a fluid container. A container preferably comprises a diaphragm or the like, which can be perforated by the intake pin. This has the advantage that the container does not need to be opened before it is inserted.

In variants or in addition, the intake pin may also be screwed to the container, in particular in a way similar to in the case of a gas cartridge.

The fluid container is preferably integrated or can be integrated in a handle of the hand-held unit. In this way, an optimum position of the center of gravity of the hand-held unit with the integrated fluid container is achieved, in particular in the case of a hand-held unit that is largely made of plastic. The fluid container in the hand-held unit is preferably exchangeable, so that the hand-held unit can easily be recharged.

In variants, the fluid container may be formed separately (see below).

During operation, the hand-held unit is preferably movable independently of the fluid container, in particular can be aimed at a target body. In this variant, the fluid container is formed as a component that is independent of the hand-held unit. The hand-held unit can consequently be connected to the fluid container, in particular an intake pin in the fluid container, for example by way of a tube or the like. This allows the fluid container to be made to greater dimensions, without impairing the handling of the hand-held unit. The device can consequently be used in longer operations, without the device having to be recharged or a fluid container exchanged. Furthermore, the production of a single, larger fluid container can also be achieved inexpensively. A corresponding hand-held unit can consequently be formed in such a way that it is lighter and can be handled more easily. In particular, in such a hand-held unit a rechargeable battery for example can be made larger. Such a hand-held unit preferably comprises the fluid pump, in particular a peristaltic pump, a diaphragm pump or the like. In the case of a separate fluid container, it is typically of advantage if the fluid transporting means, in particular the pump, is comprised by the hand-held unit. Alternatively, however, it is also possible that the separate fluid container comprises the pump.

In variants, the fluid container may also be integrated in the hand-held unit.

During operation, the hand-held unit is preferably movable independently of the rechargeable battery, in particular can be aimed at a target body. Consequently, in one embodiment the rechargeable battery is not accommodated in the hand-held unit but takes the form of an external power supply device. The hand-held unit is in this case preferably connected to the rechargeable battery or a power supply system by way of a power cable. This on the one hand achieves the effect that the hand-held unit can be formed as lighter and easier to handle, on the other hand it also allows the rechargeable battery to be formed with greater capacity, whereby the device can be used over a longer time period.

In variants, the rechargeable battery may also be accommodated in the hand-held unit.

The hand-held unit preferably has a receptacle for an insert, the insert optionally being formed as a fluid container insert or as a connecting element to a fluid container that is separate from the hand-held unit, the device comprising in particular the connecting element. In this variant, the device may be formed in two ways, whereas the hand-held unit is formed identically for both ways. This makes particularly variable use of the device possible.

For this purpose, the hand-held unit comprises a receptacle, which may be accommodated in the grip of the hand-held unit for example in the manner of a receptacle for the magazine of a gun. In this case, the insert would be insertable into this receptacle in a way similar to a magazine. The insert can in this case correspondingly be available in the two variants, so that an exchange of the inserts is easily possible.

In the first variant, the insert comprises the fluid container. Consequently, the hand-held unit comprises the fluid container during operation. In this embodiment it is possible to dispense with an external fluid container, whereby a device that can be handled particularly easily is achieved. The fluid container is in this case preferably formed as an exchangeable container.

In the second variant, the insert comprises a connecting line, in particular a fluid connection to an external fluid container. This makes the hand-held unit lighter and handier. Moreover, the fluid container can be made larger, whereby the time for which it is used can be increased.

This provides the user with a device with which it is possible to change quickly and easily between an external fluid container and an integrated fluid container. This makes it possible to react efficiently to changing situations. In the case of use of the device as an irritant spray device, use of the connecting element together with the external irritant container may be of advantage in particular in the event of major operations, such as for example riots, in which many people are involved. On the one hand, a great store of irritant is thereby provided, on the other hand injuries can be avoided because of the distance measuring device. By contrast, the variant with the integrated fluid container is of advantage for example on patrols, since in this configuration the device is kept smaller and lighter.

In variants, it is also possible to dispense with the connecting element, in particular if the device is only intended for short, spontaneous uses.

The insert is preferably formed as a connecting element to a fluid container that is separate from the hand-held unit and as a connecting element to one or more rechargeable batteries that are separate from the hand-held unit. In this way, the heavy components of the device are kept separate, whereby the hand-held unit is particularly lightweight in the hand. On the other hand, this allows rechargeable batteries of a greater capacity to be used, whereby the maximum time for which it is used can be increased. The connecting element in this case comprises at least one electrical connection and a fluid connection, and also corresponding electrical and fluid feed lines to the hand-held unit.

In variants, in particular with a low power consumption of the propulsion drive, high power density of the rechargeable battery or for sporadic use, it is also possible to dispense with external rechargeable batteries.

The fluid container that is separate from the hand-held unit and/or the rechargeable battery that is separate from the hand-held unit preferably comprises a carrying strap, in particular a shoulder strap. In a particularly preferred embodiment, the separate fluid container comprises a tank that can be carried on the back. Such a device may be formed substantially as a backpack, the tank being able to take the form of a pouch or a dimensionally stable tank. The carrying strap may however also be formed as a simple loop for carrying over a shoulder or as a waist belt.

In variants, it is also possible to dispense with the carrying strap. Instead of a carrying strap, the fluid container may also be integrated in a vest, a jacket or the like.

The hand-held unit preferably comprises a handle with a trigger for actuating the propulsion drive. The distance measuring device is preferably likewise activated by way of the trigger. Preferably, after actuating the trigger, in a first step the distance between the target body and the hand-held unit is measured by means of the distance measuring device. Subsequently, the distance measured is preferably compared with a limit distance established in advance. If the distance measured is less than the limit distance, the propulsion drive is operated with low power output. If the distance measured is greater than the limit distance, then the propulsion drive is operated with greater output. However, it is clear to a person skilled in the art that the distance measuring device can also be used for carrying out continuous measurement. The device or the hand-held unit may for example comprise a switch for switching the device on and off, the distance measuring device measuring continuously when the device is switched on. Particularly preferably, the control unit is made such that, as a default, the control unit is adjusted to a low power output setting when the device is switched on and the output is increased after a sufficiently great distance from the target object has been measured.

In a further embodiment, a device for firing a fluid projectile at a target body comprises a hand-held unit for firing the projectile, the hand-held unit comprising a propulsion drive for accelerating the projectile, the propulsion drive comprising a cylinder for receiving a fluid and a piston that can be moved in the cylinder along a longitudinal axis and also means for achieving a relative movement between the piston and the cylinder.

In this embodiment, the device preferably comprises an energy store for operating the propulsion drive. The energy store may for example take the form of a rechargeable battery or standard battery or else a mechanical energy store, such as for example a tension or compression spring, hydropneumatic accumulator, etc. This further embodiment may comprise as a variant a distance sensor according to the first embodiment, where in particular the propulsion is controllable by way of the distance sensor (see above).

Alternatively, it is also possible to dispense with the energy store, in particular if for example a trigger is provided, whereby the energy required is provided by the user. For this purpose, the trigger may for example actuate a linear drive or a hydraulic mechanism. A person skilled in the art also knows of further variants.

The irritant is preferably located directly in the cylinder, so that when the irritant container has been emptied the cylinder together with the piston can be replaced. In this way, a risk of contamination by the user can be reduced.

Alternatively, however, a pouch-like pack, which can be introduced into the cylinder by way of a suitable coupling so that the content of the pack can be discharged by way of the nozzle, may also be provided for the irritant. Such packs are sufficiently well known to a person skilled in the art, for example as refill pouches for shampoo, shower gel, fabric softeners, etc. Consequently, the replacement containers can be kept less expensively and the cylinder-piston unit can be reused. The coupling may be formed for example as a known bottle thread, as a bayonet closure and the like. A person skilled in the art knows of variants for this. In use, the piston is moved into the cylinder, whereby the pouch-like pack is compressed by the forward movement and thus the irritant is discharged by way of the nozzle.

In a variant, the outlet nozzle is likewise held on the pouch-like pack, in particular preferably in the region which respectively centered in relation to the coupling. This in turn creates a system in which contamination by the irritant only takes place at the exchangeable pack, in the present case at the pouch-like pack with the nozzle. Alternatively, the nozzle may also be a component part of the cylinder.

The means for achieving the relative movement are preferably formed as a pump, preferably as a peristaltic pump. In variants, the relative movement may also be performed by way of a linear drive.

The piston is preferably movable by producing a negative pressure in the cylinder. Alternatively, the piston may also be subjected to pressure by the pump, so that the piston can be moved into the cylinder and the fluid discharged from the cylinder.

In a particularly preferred embodiment, the outlet nozzle through which the fluid projectile leaves is connected to the fluid container, in particular the cylinder, indirectly by way of a pump. Consequently, the fluid projectile is sucked out of the fluid container and discharged through the outlet nozzle by the pump.

The cylinder is preferably formed as a single fluid container for the fluid. In variants, a separate fluid container which serves as a storage container may be provided, it being possible for the cylinder to be filled with fluid from the storage container by a return of the piston in the cylinder.

The rechargeable battery or batteries or standard batteries may be arranged in a separate battery compartment of the hand-held unit. Furthermore, the batteries may be connected to the fluid container, so that each time a fluid container is changed the batteries are also exchanged. For this purpose, the capacity may be made to match the content of the fluid container, so that with a new battery for example the entire content of the fluid container can be fired with maximum power. In this way, simplified handling of the device is achieved, because only the filling level of the fluid container has to be monitored.

In further embodiments, the hand-held unit may also comprise further electronic components. In particular, the hand-held unit may also comprise with an LED, a pocket lamp, a target laser, a camera, a display, for example for indicating the status by way of the filling level of the fluid container or a state of charge of the rechargeable battery, a distance indication, etc.

Further advantageous embodiments and combinations of features of the invention emerge from the following detailed description and the patent claims as a whole.

BRIEF DESCRIPTION OF THE DRAWINGS

The drawings used for explaining the exemplary embodiment show.

In principle, the same parts are provided with the same reference signs in the figures.

WAYS OF CARRYING OUT THE INVENTION

Possible exemplary embodiments are described below on the basis of the figures, in the present case each having a fluid pump. However, it is clear to a person skilled in the art that the concept according to the invention also with some other propulsion drive, such as for example an electromagnetic drive in the case of a ferromagnetic projectile, etc.

Figure 1:
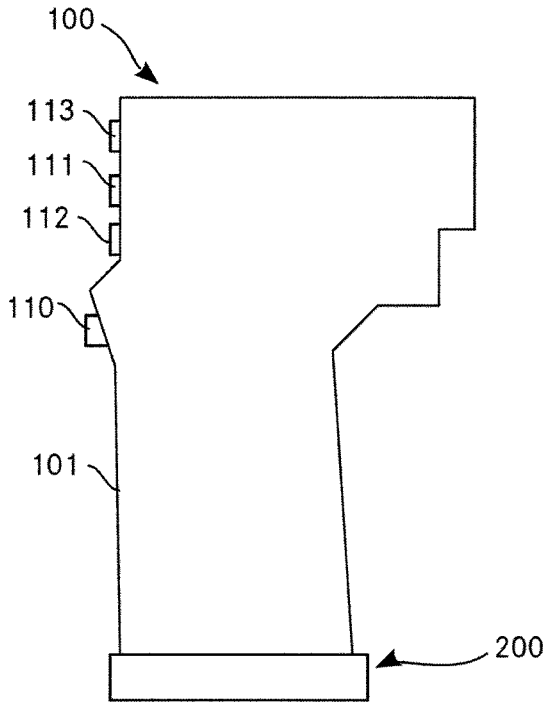
FIG. 1 a schematic side view of a first variant of a device for firing a fluid projectile with an inserted insert of a first embodiment.

FIG. 1 shows a schematic side view of a first variant of a device 100 for firing a fluid projectile with an inserted insert 200 of a first embodiment.

The device of the first variant (hereinafter "variant 100") comprises a housing 101 with a handle in a lower region. On the end face, the variant 100 has a trigger 110, which in the present case is formed as a pushbutton. However, it is clear to a person skilled in the art that instead a conventional pistol trigger, a touchscreen, in particular for example with fingerprint recognition to prevent misuse, or the like may also be formed. The variant 100 also comprises on the end face, vertically above the handle, a distance sensor 112, an outlet nozzle 111 for the irritant and also an LED 113. The variant 100 also comprises an insert 200 with the irritant.

Figure 2:
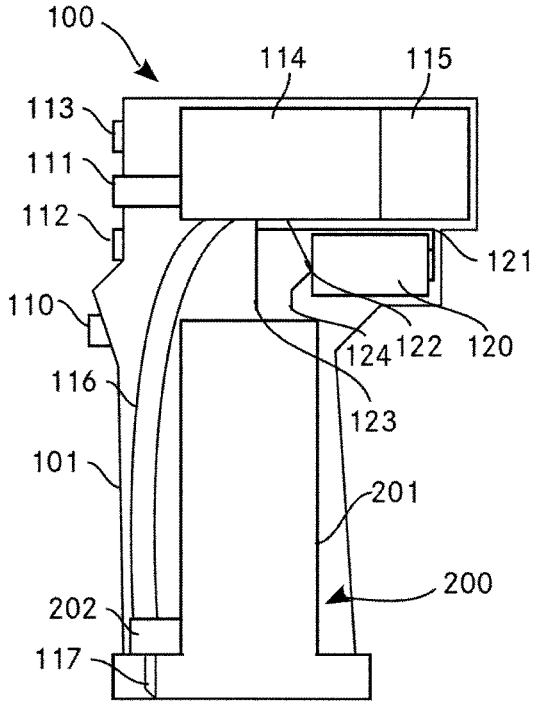
FIG. 2 the device according to FIG. 1 as a sectional representation.

FIG. 2 shows the variant 100 according to FIG. 1 as a sectional representation. Within the housing, the variant 100 also comprises a propulsion drive 114 in the form of a diaphragm pump 114, which can be controlled by way of a control unit 115. However, it is clear to a person skilled in the art that other pumps, such as for example peristaltic pumps, gear pumps or the like, can also be used. The control unit 115 is also connected to the distance sensor 112 in such a way that distances measured can be processed by the control unit 115. The distance sensor 112 is formed in the present case as a laser sensor, though other distance sensors, such as for example ultrasonic, IR, radar and the like may also be provided. The control unit 115 can activate the pump 114 in dependence on the distance measured. In the preferred embodiment, a short distance is fixed by default for safety reasons, so that the pump 114 can only pump with low output, whereby in turn a risk of injury is kept low. If then a distance from a target object that is greater than a limit distance is established by the distance sensor 112, the output is increased correspondingly by the control unit. The variant 100 also comprises two batteries 120, which according to FIG. 2 lie one behind the other, so that only one battery 120 can be seen. The batteries 120 are connected to the pump 114 by way of power lines 121, 122. The power lines 121, 122 also comprise in each case a power connection 123, 124 for an additional battery pack, which is discussed in more detail below. For a better overview, not all of the lines are depicted in the figures. It is clear to a person skilled in the art how the electronics for these devices should be provided.

The pump 114 is connected to an insert of the first embodiment 200 by way of an intake tube 116. The intake tube 116 is fixed in the housing 101 and distally comprises a piercing pin 117. The insert 200 comprises a container 201 for the irritant, and also a septum 202, which can be pierced by the piercing pin 117. The septum 202 is arranged at the foot of the container 201. The insert is held on the housing 101 by way of a locking device that is not shown, in particular a snap spring or the like. The insert 200 is formed as a disposable insert. This can be easily pulled out of the housing 101 by overcoming the holding force of the locking device, and a new insert 200 can be pushed in similarly easily, until it snaps into place.

In a preferred embodiment, two batteries, in particular two 3-volt batteries (e.g. CR123A), are used to drive the pump 114. It is consequently possible for only one battery to be used for low output and two batteries to be used for feeding the pump for high output. With the low output and a suitable geometry of the outlet nozzle, a range of about 1.5 m can be achieved; with the high output, i.e. with both batteries, a range of about 5 m can be achieved. At a range of 1.5 m, an eye injury caused by the jet can be ruled out with the greatest probability even at close proximity. When the unit is switched on, in this embodiment the pump is thus operated with one battery.

The LED is formed in the present case as a UV-LED. A UV-sensitive substance, for example uranine, is admixed with the irritant, so that the irritant is illuminated when it is exposed to UV. In this way the aiming accuracy can be increased, because the jet can be visually followed and the hit target can be detected. Furthermore, in this way the target can in addition also be identified later.

Figure 3:
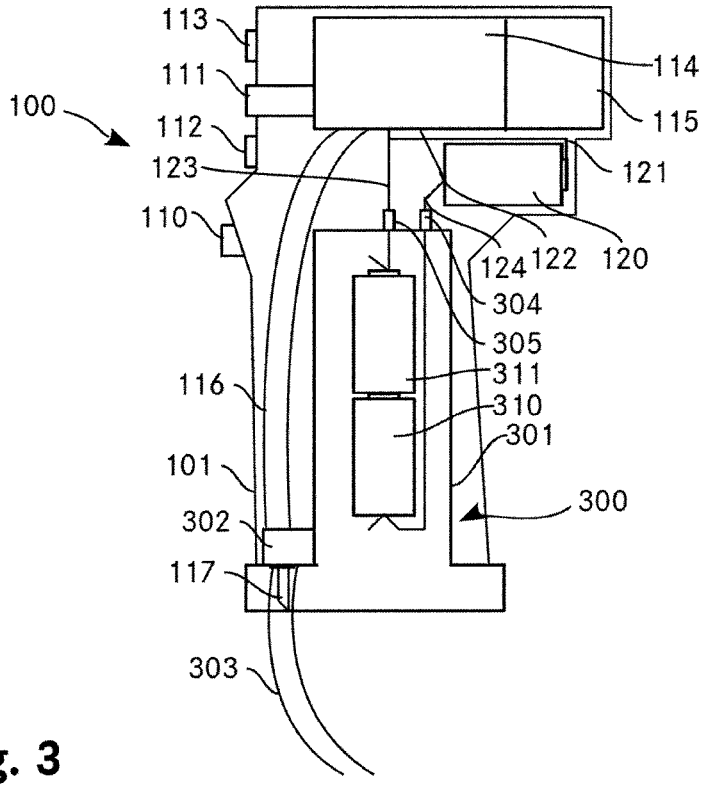
FIG. 3 a schematic side view of a first variant of a device for firing a fluid projectile with an inserted insert of a second embodiment in a sectional representation.

FIG. 3 shows a schematic side view of a first variant 100 of a device for firing a fluid projectile with an inserted insert 300 of a second embodiment in a sectional representation. In the present FIG. 3, the elements of the device for firing the fluid projectile are identical to those from FIG. 2. The only difference is in the insert 300 of the second embodiment. This insert 300 does not have a container for irritant here, but comprises additional batteries 310, 311, which are connectable to the power connections 123, 124 of the variant 100 by way of two power connections 304, 305. This allows the capacity of the device to be increased significantly. The insert 300 also comprises a tube 303, which is connectable to an external container with the irritant. When the intake pin 117 pierces the septum 302 of the insert 300, it protrudes directly into the tube 303, so that irritant can be taken in by the pump 114 by way of the tube 303.

Figure 4:
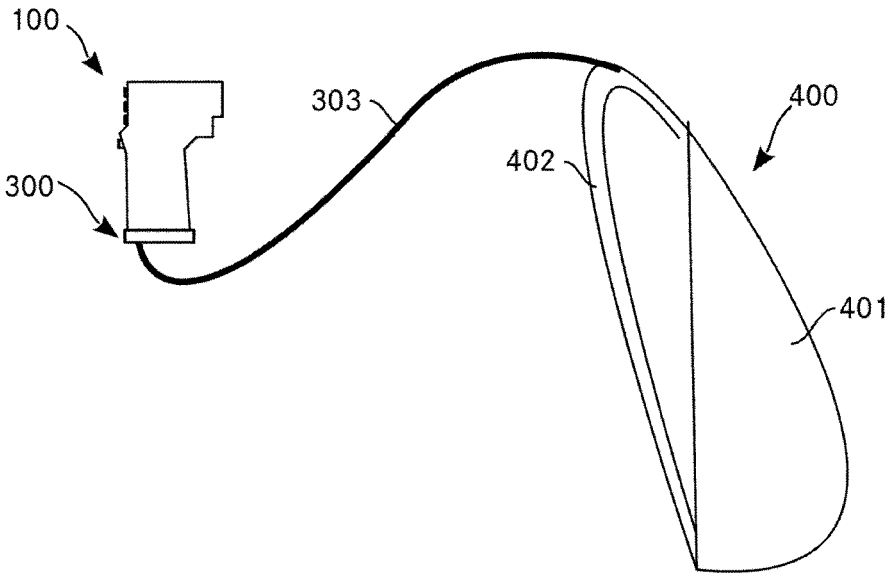
FIG. 4 a schematic representation of an arrangement comprising a first variant of a device for firing a fluid projectile with an inserted insert of a second embodiment and a backpack connected to the insert.

FIG. 4 shows a schematic representation of an arrangement comprising a first variant 100 of a device for firing a fluid with an inserted insert 300 of a second embodiment and a backpack 400 connected to the insert. The tube 303 is connected to a container 401 in the backpack. The backpack in the present case comprises shoulder straps 402, so that it can be carried on the back. Alternatively, the container 401 may however also be fastened to a waist belt. Furthermore, the tube may also be made sufficiently long that, for example, a single container can be used for a number of devices for firing irritant.

The insert 300 can be pulled out of the housing 101 similarly easily and replaced for example by an insert 200.

It is clear to a person skilled in the art that it is possible to dispense with the batteries in the insert 300 if the batteries are likewise arranged externally, in particular for example in the backpack 400. This allows the capacity to be increased further.

Figure 5:
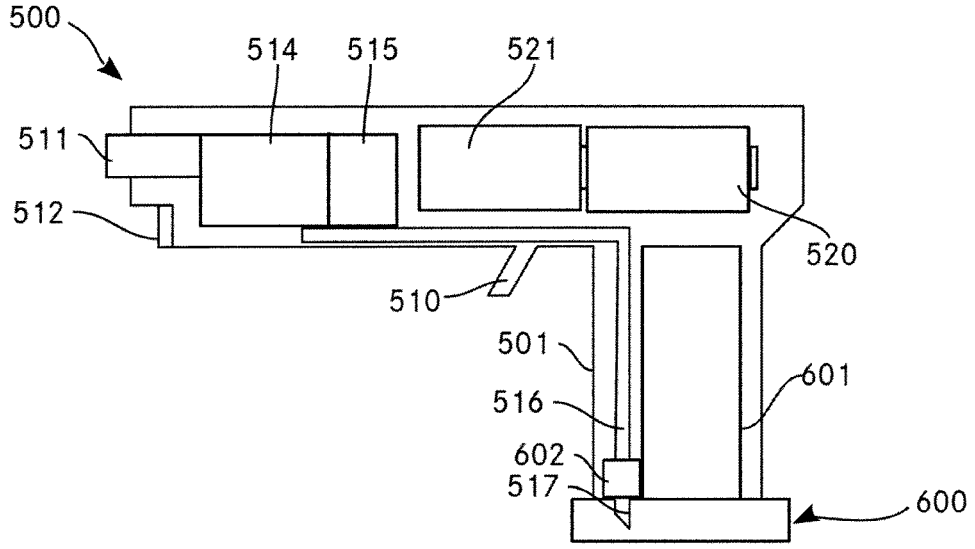
FIG. 5 a schematic side view of a second variant of a device for firing a fluid projectile.

FIG. 5 finally shows a schematic side view of a second variant 500 of a device 500 for firing a fluid projectile.

The device 500 in the present case comprises a distance sensor 512 underneath an outlet nozzle 511, whereby likewise, as in the case of the device described above, a distance can be measured. The distance measured is evaluated by a control unit 515, whereupon an output for the pump 514 is defined. The pump 514 may in the present case be driven by way of two batteries. In FIG. 5, no electrical lines are depicted to provide a better overview. The device 500 comprises within the housing 501 an intake tube 516, which connects the piercing pin 517 to the pump 514.

In the handle of the housing 501 of the device 500, once again an insert 600, which comprises a container 601 for a fluid and a septum 602, has been pushed in. With the insert 600 inserted, the piercing pin 517 pierces the septum, so that the fluid can be transported through the tube 516 to the pump.

It is clear to a person skilled in the art that it is possible to dispense with the insert 600. In this case, the housing 501 itself may be provided as a fluid container, the electronics having to be sealed off with respect thereto. The housing may in this case simply be provided with a refill opening, which is for example provided with a plug or a screw closure.

Figure 6A:
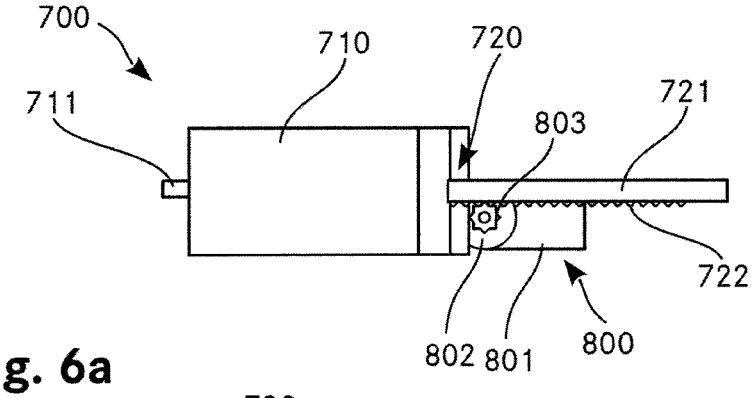
FIG. 6*a* a schematic plan view of a third variant of a device for firing a fluid projectile comprising a fluid container realized by a cylinder and a piston, before use when the fluid container is full.

FIG. 6*a* shows a schematic plan view (from above) of a third variant of a device for firing a fluid projectile comprising a fluid container realized by a cylinder 710 and a piston 720, before use and with the fluid container full. The present embodiment of a discharge device 700 is consequently constructed in a way similar to a syringe, with a cylinder 710 and a piston 720 that is movable therein and is connected in one piece to a piston rod 721. The piston rod 721 comprises in turn a toothed rack 722, which is likewise connected in one piece to the piston rod. The cylinder 710 comprises a nozzle 711, through which the fluid, in particular the irritant, can leave as a fluid projectile. The piston 720 is movable in the cylinder 710 by way of a drive motor unit 800. However, it is clear to a person skilled in the art that the piston can in principle also be actuated manually or by way of an energy store known to a person skilled in the art, such as for example a spring or the like. The drive motor unit 800 in the present case comprises a drive motor 801 with a reduction gear unit 802, whereby the drive gearwheel 803 of the drive motor unit 800 can be driven. The drive gearwheel 803 is in the present case in engagement with the toothed rack 722 of the piston rod 721, so that, when there is a counterclockwise rotation of the drive gearwheel 803, the toothed rack 722, and consequently the piston 720, is moved into the cylinder 710, and thereby brings about a discharge of the fluid.

The drive motor unit 800 may preferably be electronically regulated; in particular, the rotational speed may preferably be regulated substantially independently of the output, whereby the discharge velocity of the fluid is determinable in dependence on the diameters of the nozzle and the cylinder. Furthermore, the device may be controlled in such a way that the discharge takes place during a time period that is predetermined, in particular programmed, or determined by the user.

Figure 6B:
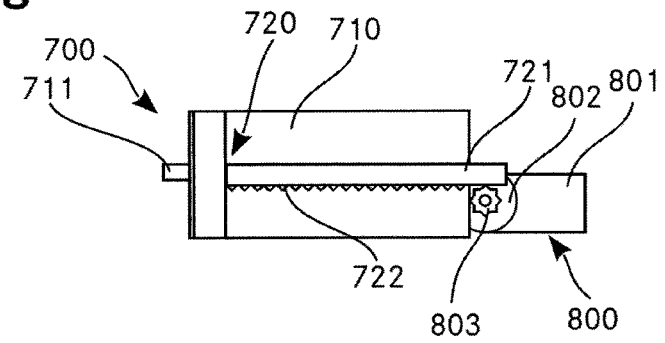
FIG. 6*b* a schematic plan view according to FIG. 6*a*, after use when the fluid container is empty.

FIG. 6*b* shows a schematic plan view according to FIG. 6*a*, after use when the fluid container is empty. In this state, the piston 720 has been made to enter the cylinder 710 completely. It can be seen in this case that the toothed rack does not protrude as far as the end of the piston rod 721 opposite from the piston 720. After the emptying of the cylinder 710, the drive gearwheel 803 disengages from the toothed rack 722, so that the drive gearwheel 803 idles. This achieves overload protection for the motor in the end position in an easy way.

Figure 7A:
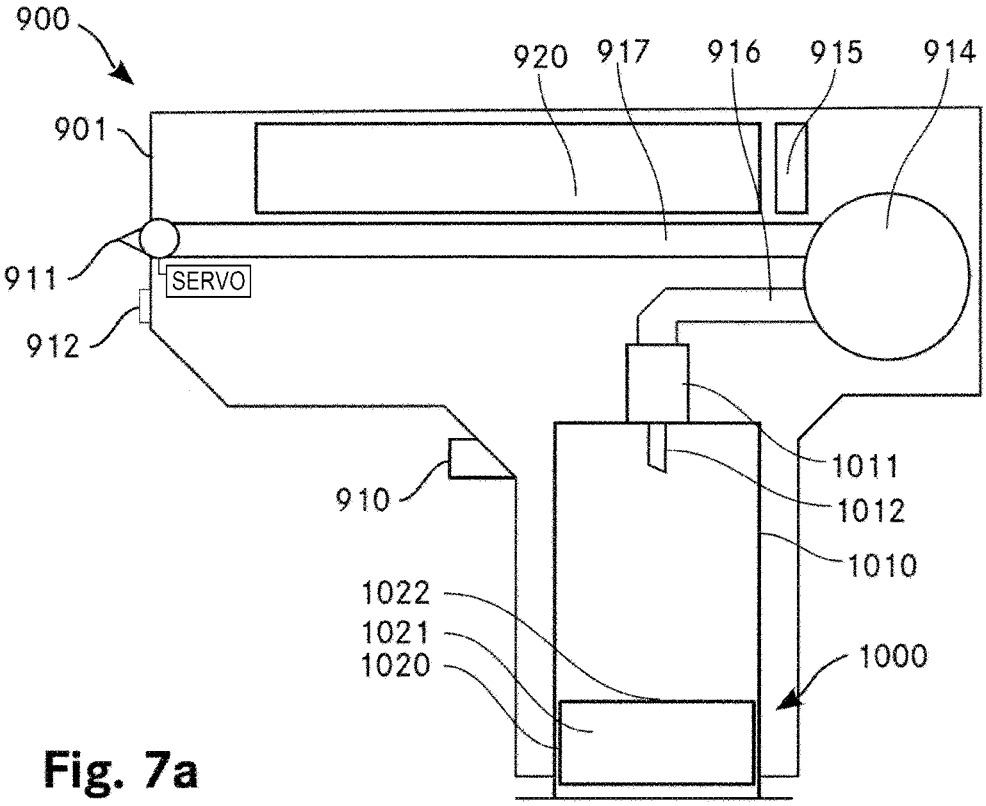
FIG. 7*a* a schematic side view of a fourth variant of a device for firing a fluid projectile when the fluid container is full.

FIG. 7*a* shows a schematic side view of a third variant of a device 900 for firing a fluid projectile, in particular an irritant, with a full fluid container 1000.

Figure 7B:
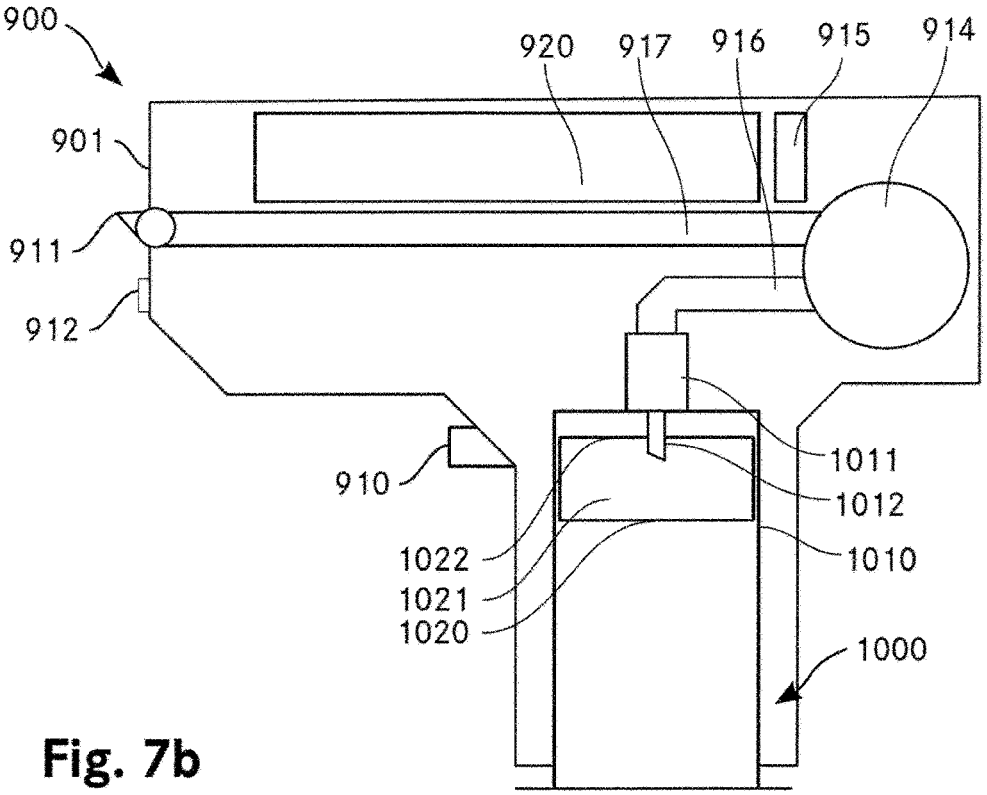
FIG. 7*b* a schematic representation according to FIG. 7*a* when the fluid container has been emptied and the outlet nozzle is elevated.

The term plane of the housing is understood hereinafter as meaning a plane that lies substantially in the plane of symmetry of the housing represented, i.e. in the plane of the page of FIGS. 7*a* and 7*b*. In FIGS. 7*a* and 7*b* once again no electrical lines are depicted to provide a better overview.

The variant 900 in the present case comprises a housing 901, in which a fluid container 1000 formed as an insert is insertable. The housing 901 comprises a peristaltic pump 914, which is fluidically connected to an intake tube 916 and a nozzle tube 917. The nozzle tube 917 opens out in the nozzle 911, which in the present case is formed as pivotable about an axis perpendicular to the plane of the housing (see below). The housing 901 also comprises a distance sensor 912, which is arranged underneath the nozzle 911. The data of the distance sensor 912 are sent to a control unit 915, which is likewise located in the housing 901 and where these data are processed. Arranged in the housing 901 is a battery 920, whereby the peristaltic pump 914, the distance sensor 912 and the control unit 915 are fed. Finally, the housing 901 comprises a trigger 910, whereby the function of the device can be initiated, in particular a fluid projectile, preferably an irritant projectile, can be fired.

While the peristaltic pump in the present case lies with an axis of rotation of the motor at right angles to the plane of the housing, for reasons of space it may also lie with the axis of rotation within the plane of the housing. Furthermore, the rotor of the peristaltic pump may be fitted over a gear unit of the motor or over the motor itself, so that the portion of tube that is to be pinched during operation is laid around the motor or around the gear unit. A particularly compact form of construction is thereby achieved.

The nozzle 911 is in the present case pivotable in a plane parallel to a cross-sectional area of the housing 901. This allows the parabolic flight to be substantially compensated in dependence on the power output of the propulsion drive, that is to say the peristaltic pump 914, and the distance measured by the distance sensor 912. The nozzle 911 is preferably pivotable automatically by way of a micro servo, but may also be formed as pivotable manually. Finally, it is also possible to dispense with the pivotability. In particular, the nozzle may also be fixedly pivoted, so that the parabolic flight is compensated just by the pump output and the distance measured.

The housing 901 also comprises a receptacle for the fluid container 1000. The fluid container 1000 comprises a cylinder 1010, which on the end face comprises a Luer lock connection 1011. The counterpart of the Luer lock connection is comprised by the distal end of the intake tube 916. The cylinder 1010 can in this way be mounted by being fitted into the housing 901 and subsequently turned, in particular by an angle of 90°. A piston 1020 is movably mounted within the cylinder 1010.

In the method, in a first step a distance from the target object is determined by way of the distance sensor 912. These distance data are sent to the control unit 915 and processed there. Depending on the distance measured, the necessary power output for the propulsion drive, that is to say the peristaltic pump, is then determined. When the trigger 910 is pressed, the peristaltic pump 914 is put into operation. This makes a negative pressure act on the cylinder 1010, whereby the fluid located in the cylinder is sucked out of it. At the same time, as a result the piston 1020 moves in the direction of the closed end of the cylinder 1010. The fluid is discharged through the nozzle 911 by way of the nozzle line 917. In the design with the pivotable nozzle, a balance between the nozzle elevation and the pump output can then be found on the basis of the distance measured, i.e. the output of the pump can be reduced when there is a greater firing angle.

The cylinder in the present case also comprises an optional pin 1012, which is in line with the Luer lock connection 1011 and protrudes inwardly, which is discussed in more detail in connection with FIG. 7*b*.

FIG. 7*b* shows a schematic representation according to FIG. 7*a* when the fluid container 1000 has been emptied and the outlet nozzle 911 is elevated. The piston 1020 in the present case comprises an interior space separated off by a diaphragm 1022 and containing a cleaning agent 1021. The diaphragm 1022 is directed toward the pin 1012. If the irritant store is then emptied, the piston 1020 moves toward the pin 1012, so that the pin 1012 perforates the diaphragm 1022. The cleaning agent 1021 is then taken in through the pin 1012, whereby the lines and the nozzle of the device can be cleaned. Instead of the cleaning agent 1022, other substances may also be provided, in particular a marking substance or the like.

To sum up, it can be stated that, according to the invention, a device for firing a projectile is provided, the kinetic energy of the projectile being controlled on the basis of a distance between the device and a target object, in particular being able to be reduced when the distance is small. This is of great advantage in particular in the case of pepper sprays, because in this way it is possible for example to avoid eye injuries during use at a short distance.

The invention claimed is:

1. Device for firing a fluid projectile at a target body, comprising:

a hand-held unit for firing the projectile, the hand-held unit including a pump propulsion drive for accelerating the projectile, and a distance measuring device for measuring a distance between the hand-held unit and the target body;

an energy store for operating the propulsion drive;

a control unit configured to control the pump based on the distance measured;

a nozzle pivotable in a plane parallel to a cross-sectional area of the hand-held unit along a firing axis; and a servo configured to pivot the nozzle based on the distance measured and a power output of the pump.

2. Device according to claim 1, wherein the hand-held unit comprises the control unit.

3. Device according to claim 1, wherein the power output of the pump is controllable in dependence on the distance measured.

4. Device according to claim 1, wherein a firing angle of the projectile in relation to the hand-held unit is controllable in dependence on the distance measured and/or in dependence on the power output of the pump.

5. Device according to claim 1, wherein the pump is electrically operable.

6. Device according to claim 5, wherein the energy store comprises at least one rechargeable battery.

7. Device according to claim 1, wherein the pump is formed as a peristaltic pump.

8. Device according to claim 1, wherein the hand-held unit comprises a fluid container, which is fluidically connectable to the pump.

9. Device according to claim 8, wherein the pump is connectable to the fluid container in the manner of a force closure by way of a conical connection.

10. Device according to claim 9, wherein the conical connection also comprises a securement, in order to secure the conical connection.

11. Device according to claim 9, wherein the securement is a screw connection.

12. Device according to claim 8, wherein the fluid container and the pump comprise a Luer lock connection, by way of which the fluid container can be fluidically connected to the pump.

13. Device according claim 8, wherein the fluid container comprises a cylinder with a piston that can be moved within the cylinder.

14. Device according claim 8 wherein the fluid container comprises a main chamber for a first fluid and a secondary chamber for a second fluid, the main chamber being separated from the secondary chamber by a diaphragm.

15. Device according to claim 14, wherein the device comprises a pin, the diaphragm being pierceable by means of emptying the main chamber.

16. Device according to claim 1, wherein the piston and the cylinder form an exchangeable unit.

17. Device according to claim 1, wherein the distance measuring device comprises a laser sensor.

18. Device according to claim 1, wherein the hand-held unit has a receptacle for an insert, the insert optionally being formed as a fluid container insert or as a connecting element to a fluid container that is separate from the hand-held unit.

19. Device according to claim 1, wherein below a limit distance the propulsion drive is not activatable.

20. Device according to claim 1, wherein, when exceeding a maximum limit distance, the propulsion drive is not activatable.

21. Method for operating a device for firing a fluid projectile at a target body, the device comprising a pivotable output nozzle, a hand-held unit for firing a projectile, and also including a propulsion drive for accelerating the projectile and a distance measuring device, the device also comprising an energy store for operating the propulsion drive, wherein the propulsion drive is a pump and comprises a control unit, the method comprising measuring a distance between the hand-held unit and the target body;

controlling a power output of the pump propulsion drive in dependence on the distance measured;

pivoting the nozzle by means of a servo based on the distance measured and the power output of the pump; and firing the fluid from the pivoted nozzle.

22. Method according to claim 21, wherein the device comprises a target laser, wherein the target laser is pivotably formed, wherein a laser beam of the target laser is aligned in dependence on the distance and the power output of the propulsion drive.

23. Method according to claim 21, wherein below a limit distance, the propulsion drive is not activated.

24. Method according to claim 21, wherein, when exceeding a maximum limit distance, the propulsion drive is not activated.

* * * * *